US011401062B2

(12) United States Patent
Mous

(10) Patent No.: US 11,401,062 B2
(45) Date of Patent: Aug. 2, 2022

(54) PACKAGING ASSEMBLY FOR WRAPPING MAIL ITEMS OF DIFFERING SIZES

(71) Applicant: Buhrs Packaging Solutions B.V., Zaandam (NL)

(72) Inventor: Fransiscus Maria Mous, Limmen (NL)

(73) Assignee: BUHRS PACKAGING SOLUTIONS B.V., Zaandam (NL)

( * ) Notice: Subject to any disclaimer, the term of this patent is extended or adjusted under 35 U.S.C. 154(b) by 36 days.

(21) Appl. No.: 16/903,877

(22) Filed: Jun. 17, 2020

(65) Prior Publication Data

US 2020/0391888 A1 Dec. 17, 2020

(30) Foreign Application Priority Data

Jun. 17, 2019 (NL) ..... 2023321

(51) Int. Cl.
*B65B 9/087* (2012.01)
*B65B 11/16* (2006.01)
(Continued)

(52) U.S. Cl.
CPC ..... *B65B 9/087* (2013.01); *B65B 11/16* (2013.01); *B65B 35/44* (2013.01); *B65B 35/56* (2013.01)

(58) Field of Classification Search
None
See application file for complete search history.

(56) References Cited

U.S. PATENT DOCUMENTS 3,339,337 A * 9/1967 Rapp ..... B65B 9/06 53/550
3,550,354 A * 12/1970 Bate ..... B65B 9/06 53/550

(Continued)

FOREIGN PATENT DOCUMENTS

EP 0 870 678 A1 10/1998

OTHER PUBLICATIONS

Dutch Search Report, issued in Priority Application No. 2023321, dated Feb. 18, 2020.

*Primary Examiner* — Hemant Desai
*Assistant Examiner* — Tanzim Imam
(74) *Attorney, Agent, or Firm* — Birch, Stewart, Kolasch & Birch, LLP

(57) ABSTRACT

A packaging assembly for wrapping mail items of differing sizes and each including at least one mail component or a stack of mail components, wherein the packaging assembly comprises: a mail item collecting assembly, a flow wrap station comprising a folding assembly for creating a folded web, a longitudinal sealing assembly for creating a longitudinal seal, and a cross sealing assembly. The packaging assembly is characterized in that the flow wrap station is configured to create said folded web so as to have a single side fold which is positioned on a first side of the subsequently placed mail items, wherein the side fold extends in a transport direction. The packaging assembly further comprises a measuring assembly for determining a transverse position of a second side of the mail item which is opposite the first side. The longitudinal sealing assembly has an infeed end which is positioned downstream of the cross sealing assembly. The longitudinal sealing assembly is configured for creating a mail product by applying a longitudinal seal in each intermediate mail product at the second side of the mail item. The longitudinal sealing assembly (Continued)

Figure 1:
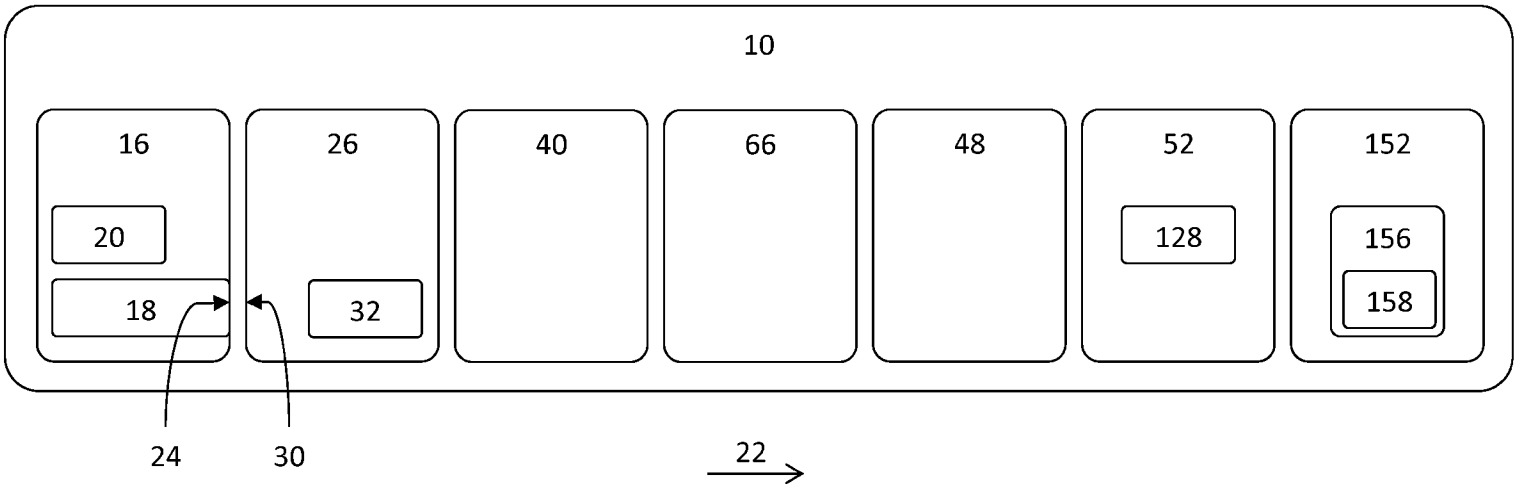

comprises a positioning assembly for controlling a transverse position of the longitudinal seal for each intermediate mail product, wherein the transverse position of the longitudinal seal is determined by the transverse position of the second side of the mail item.

25 Claims, 15 Drawing Sheets

(51) Int. Cl.
*B65B 35/44* (2006.01)
*B65B 35/56* (2006.01)

(56) References Cited

U.S. PATENT DOCUMENTS

| | | | | | |
|---|---|---|---|---|---|
| 3,581,461 | A * | 6/1971 | McDurmont | B65B 9/06 | 53/77 |
| 5,299,410 | A * | 4/1994 | Freeman | B65B 59/003 | 53/553 |
| 5,417,041 | A * | 5/1995 | Hansen | B65B 53/063 | 53/550 |
| 10,967,995 | B1 * | 4/2021 | Hoffman | B65B 9/08 | |
| 2006/0272283 | A1 * | 12/2006 | Kawanishi | B65B 11/54 | 53/76 |
| 2009/0113849 | A1 * | 5/2009 | Giuliani | B65G 47/31 | 53/446 |
| 2010/0199600 | A1 * | 8/2010 | Dax | B29C 66/81417 | 53/550 |
| 2013/0014476 | A1 * | 1/2013 | Stork | B65B 51/306 | 53/552 |

* cited by examiner

PACKAGING ASSEMBLY FOR WRAPPING MAIL ITEMS OF DIFFERING SIZES

FIELD

The invention relates to a continuously flow wrap packaging assembly for wrapping mail items of differing sizes and each including at least one mail component or a stack of mail components.

BACKGROUND

Increasingly, mail item wrapping scenarios require flexible customization of mail items in combination with high efficiency. Dimensions and compositions of mail items may therefore need to be varied between subsequent mail items, e.g. a mail item may comprise a different selection of mail components compared to a subsequent mail item.

EP0870678B1 discloses an approach for taking varying heights of mail items into account. An approach for taking varying heights of mail products into account, as is disclosed in EP0870678B1, may still result in wraps being oversized in at least the transverse direction, especially in the case of varying widths of subsequent mail items. This aspect is complicated by the fact that conventionally, the longitudinal seal is continuously applied to the stream of mail items, upstream of the cross sealing assembly, before separating the mail products in the cross sealing assembly.

U.S. Pat. No. 5,299,410 discloses a packaging method and mechanism to be used for forming a shrink wrap package which will shrink wrap stacks of paper of different size. US'410 does not disclose that the web is supplied continuously and in view of the construction it is clear that the web of US'410 is supplied intermittently and the sealing is performed when the web and the stack enclosed by the web is stationary. For example, column 2, lines 63-66 describe that the heat seal knives 10, 11, 12 are vertically moveable. This implies that the web is stationary when the sealing takes place because otherwise, the heat seal knives 10, 11, 12 should additionally be able to move in the transport direction of the web during sealing. In view thereof, US'410 is of a completely different type of machine than the continuous flow wrap machine of EP'678 and of the present invention. US'410 discloses two embodiments. The first embodiment shown in FIG. 1 does not include a fold wrap station which is configured to continuously fold the web around the mail items thereby creating a folded web so as to have a single side fold which is positioned on a first side, wherein the side fold extends in the transport direction. Instead, an upper foil web and a lower foil web are supplied above and below a stack of mail items. The transverse position of two longitudinal seal knives may be varied dependent on information stored in a computer to accommodate the size of the stack. It is disclosed that the actual size of the stack may be sensed by sensing means before it reaches the seal module. The second embodiment shown in FIG. 2 also does not include a fold wrap station which is configured continuously fold the web around the mail items to create a folded web so as to have a single side fold which is positioned on a first side, wherein the side fold extends in the transport direction. Instead, the single roll of wrap supplies a web which is already stored in a folded condition on the roll along two longitudinal fold lines and in which the upper and lower laminates 8, 9 are positioned on top of each other. The sealer module of the second embodiment has means for spreading the two laminates 8, 9 apart and to subsequently cover a stack of mail items. Subsequently, the thus covered stack then moves to the sealing area which seals the edges in a manner similar to the embodiment shown in the first embodiment. For both embodiments disclosed in US'410, two longitudinal seals are formed at both longitudinal sides of the stack of mail items. Additionally, US'410 does not disclose a cross sealing assembly which is configured for cross sealing the folded web between the subsequently placed mail items and for separating from the folded web to form an intermediate product. As a consequence, the longitudinal seal knives disclosed in US'410 do not seal an intermediate product which is already separated from the continuous web but, instead, seal simultaneously with the transverse sealing knife 10 around the stack on laminate parts which are not yet separated from the web which has been supplied to the sealing station. The structures of EP'678 and US'410 and the type of operation, continuously flow wrap versus intermittent, are completely different from each other. In EP'678 the width of the package is fixed. The width is not determined by a position of a longitudinal seal but by the distance between two longitudinal fold lines. In US'410 the width of the package to be formed is variable but is not determined by a longitudinal fold line but by the distance between two longitudinal seals.

SUMMARY

In the subsequent description, a mail product is a packaged mail item and a mail item may comprise one mail component or a stack of a plurality of mail components.

Mail components of subsequent mail items may be of different dimensions. Also, relative positions and orientations of corresponding mail components may vary between subsequent mail items, e.g. due to instabilities induced by stacking of mail components.

Such variation of dimensions between mail items needs to be taken into account in order to avoid faults in the wrapping process. In particular, the seals need to be positioned appropriately with respect to the mail items in order to ensure that all mail products are fully wrapped and have appropriate seals. In a conventional approach, the seals are therefore positioned to accommodate for the largest possible dimensions in a batch of mail items. As a disadvantageous result, many mail products will have oversized wraps, which is undesired and may even be prohibited by postal services responsible for delivering the mail product to its recipient.

It is an object of the present invention to provide a continuously flow wrap packaging assembly for wrapping mail items of differing sizes and each including at least one mail component or a stack of mail components, wherein the longitudinal seal is positioned appropriately for each mail item and wherein mail items are wrapped tightly in the transverse direction.

Therefore, the present invention provides an assembly according to claim 1. In particular, the invention provides a packaging assembly for wrapping mail items of differing sizes and each including at least one mail component or a stack of mail components. To that end, the packaging assembly comprises:

a mail item collecting assembly including a collecting conveyor and at least one feeder for dispatching individual mail components to the collecting conveyor so as to compose the mail items which are subsequently transported in a transport direction to a downstream end of the collecting conveyor;

a flow wrap station which is configured for wrapping a continuous web of material around the mail items, wherein the flow wrap station has an infeed end which connects to the downstream end of the collecting conveyor for subsequently placing on the continuous web the mail items composed in the collecting assembly, wherein the flow wrap station comprises a folding assembly configured to continuously fold the web around the mail items, thereby creating a folded web;

a longitudinal sealing assembly for creating a longitudinal seal;

a cross sealing assembly which is positioned downstream of the folding assembly and is configured for cross sealing the folded web between the subsequently placed mail items and for separating from the folded web an intermediate mail product comprising a downstream mail item of the subsequently placed mail items and an associated web part.

The packaging assembly is characterized in that the flow wrap station is configured to create said folded web so as to have a single side fold which is positioned on a first side of the subsequently placed mail items, wherein the side fold extends in the transport direction. The packaging assembly further comprises a measuring assembly for determining a transverse position of a second side of the mail item which is opposite the first side. The longitudinal sealing assembly has an infeed end which is positioned downstream of the cross sealing assembly. The longitudinal sealing assembly is configured for creating a mail product by applying a longitudinal seal in each intermediate mail product at the second side of the mail item. The longitudinal sealing assembly comprises a positioning assembly for controlling a transverse position of the longitudinal seal for each intermediate mail product, wherein the transverse position of the longitudinal seal is determined by the transverse position of the second side of the mail item.

The present invention further provides a method according to claim 10. In particular, the method is for wrapping mail items of differing sizes and each including at least one mail component or a stack of mail components. The method comprises:

providing a packaging assembly according to the invention;

composing mail items on the collecting conveyor by receiving mail components from the at least one feeder and transporting the mail items on the collecting conveyor in a transport direction to a downstream end of the collecting conveyor;

wrapping a continuous web of material around the mail items by feeding a continuous web to the infeed end of the flow wrap station, placing the composed mail items subsequently on the continuous web and continuously folding the web around the mail items, thereby creating a folded web having a side fold which is positioned on a first side of the subsequently placed mail items, wherein the side fold extends in the transport direction;

cross sealing the folded web between the subsequently placed mail items and separating from the folded web an intermediate mail product comprising a downstream mail item of the subsequently placed mail items and an associated web part;

determining a transverse position of a second side of each mail item, wherein the second side is opposite the first side;

determining a transverse position of a longitudinal seal for each intermediate mail product based on the transverse position of the second side of the respective mail item; and creating a mail product by applying the longitudinal seal in each intermediate mail product at the transverse position determined for that intermediate mail product.

The invention thus advantageously provides a solution for wrapping mail items tightly, particularly mail items of varying widths, resulting in mail products having appropriately sized wraps in at least the transverse direction.

In an embodiment, the packaging assembly may further comprise an alignment assembly having an infeed end positioned upstream of the longitudinal sealing assembly, preferably upstream of the measuring assembly, and downstream of the cross sealing assembly, wherein the alignment assembly is configured to move the individual mail components of the mail item to cause alignment of edges of the individual mail components of the mail item along and adjacent to the side fold.

The alignment assembly can thus advantageously minimize the width of the mail item, thus providing the possibility for subsequently forming a tighter wrap in the transverse direction.

In an embodiment, the alignment assembly may comprise a first tilting assembly configured to tilt the intermediate mail product around an axis of rotation from a first orientation to a second orientation, wherein the axis of rotation extends substantially in the transport direction, wherein the second orientation is a substantially less horizontal orientation compared to the first orientation, and wherein, in the second orientation, the gravity force exerted on the individual mail components has a force component which is directed towards the side fold.

Thus, the alignment assembly may advantageously enable leveraging effects of gravity to move the individual mail components of the mail item to cause alignment of edges of the individual mail components of the mail item along and adjacent to the side fold. Thus a relatively simple alignment of mail components is achieved which does not require physical contact of positioning actuators with the individual mail components. Consequently, the risk of damage to the individual mail components is minimized.

The first tilting assembly may comprise a dispatch timing assembly positioned at an infeed end of the first tilting assembly, configured to control the tilting of each intermediate mail product, wherein the dispatch timing assembly comprises a plurality of support surfaces connected to a rotatable shaft and extending radially outwardly from the shaft, wherein the shaft extends substantially in the transport direction. Each support surface of the dispatch timing assembly preferably comprises a transport conveyor for guiding each intermediate mail product in the transport direction.

Such a dispatch timing assembly advantageously enables to prevent intermediate mail products from twisting during the tilting, wherein twisting can lead to tearing of the associated web part, among other possible faults.

In an embodiment, the alignment assembly may further comprise a back tilting assembly positioned downstream of the first tilting assembly. The back tilting assembly is configured to tilt the intermediate mail product around a second axis of rotation from the second orientation to a third orientation, wherein the second axis of rotation extends substantially in the transport direction. The third orientation is a substantially more horizontal orientation compared to the second orientation.

The third orientation may correspond to an infeed orientation of the longitudinal sealing assembly, being a more suitable orientation for applying a longitudinal seal compared to the second orientation, while enabling that the previously realized alignment of edges of mail components be maintained.

The longitudinal sealing assembly may comprise a heat seal head, in particular a seal swing head.

Such a heat seal head advantageously provides means for applying the longitudinal seal and for creating a tightly wrapped mail product.

In an embodiment, the heat seal head may be connected to the positioning assembly to vary and control a transverse position of the heat seal head in dependence of the transverse position of the second side of the respective mail item. The longitudinal sealing assembly of this embodiment comprises: a longitudinal sealing conveyor for further transporting the intermediate mail product substantially in the transport direction; a transverse guide extending in a direction transverse to the transport direction; a carriage to which the longitudinal sealing conveyor and the heat seal head are connected for varying a transverse position thereof; and a transverse actuator for moving the carriage with the longitudinal sealing conveyor and the heat seal head along the transverse guide and for positioning these at a desired transverse position.

Advantageously, such a longitudinal sealing assembly enables receiving intermediate mail products at controllably varying transverse positions on the longitudinal sealing conveyor, effectively compensating for variations of mail item widths between mail items of subsequent intermediate mail products.

In an alternative embodiment, the positioning assembly may comprise an intermediate mail product transverse displacement assembly configured to move a respective intermediate mail product in a direction transverse to the transport direction. The intermediate mail product transverse displacement assembly of this embodiment is positioned upstream of the heat seal head which has a substantially fixed position. In a further elaboration of this embodiment, the intermediate mail product transverse displacement assembly may comprise: a guide, for example a rod or a roller, positioned along the transport direction at a transverse position substantially corresponding to a transverse position of the heat seal head, and forming a narrow passage for two end flaps of the associated web part, wherein the narrow passage is substantially small with respect to a thickness of the mail item; a second clamping assembly positioned at an opposite side of the guide from the mail item and configured to clamp the two end flaps; a push bar positioned in between the guide and the second clamping assembly and configured to push the two end flaps in between the guide and the second clamping assembly in an outward direction from the plane between the guide and the second clamping assembly so as to pull the two end flaps through the narrow passage thereby repositioning the mail item relative to the heat seal head.

Advantageously, such a longitudinal sealing assembly effectively enables alignment of the second sides of the mail items to a substantially fixed transverse position, substantially corresponding to a transverse position of the heat seal head, while maintaining the previously obtained alignment of edges of mail components to the side fold of the associated web part.

The intermediate mail product transverse displacement assembly may further comprise: the previously defined measuring assembly. The determining of the transverse position of the second side of the mail item comprises determining a displacement resistance, particularly an increased displacement resistance, of the push bar. The intermediate mail product transverse displacement assembly of this embodiment additionally comprises a displacement controller configured to reduce the displacement of the push bar, depending on the displacement resistance.

In such an assembly, the aspect of measuring a transverse position of the second side of the mail item is effectively combined with adjusting that transverse position to a substantially fixed transverse position.

Optionally, the collecting conveyor is provided with one or more alignment means configured for moving one or more of the individual mail components of the mail item transverse to the transport direction prior to wrapping in the flow wrap station, for example moving one individual mail component with respect to another individual mail component of the same mail item and/or moving one or more individual mail components, for example together, transverse to a transport path the collecting conveyor.

Such alignment means can advantageously minimize the width of the mail item, thus providing the possibility for subsequently forming a tighter wrap in the transverse direction. As such, the alignment means can provide an alternative or addition to the above-described alignment assembly. A preferred packaging assembly comprises both the alignment means and the alignment assembly. It has been found that such a preferred packaging assembly can provide particularly good wrapping of a wide variety of mail items.

The alignment means may be realized in various ways. For example, the alignment means may comprise one or more spring elements, for example leaf springs, which are arranged along the conveyor to bias mail items transverse to the transport direction upon contact with the spring elements. Such spring elements can advantageously cause a mail component to overlap more with an underlying mail component of the same mail item, thus enabling a tighter wrap.

Alternatively or additionally the alignment means may comprise one or more rollers arranged in a transport surface of the collecting conveyor, which rollers define a roller axis which extends relative to the transport direction at an angle of more than zero degrees and less than 90 degrees, for example an angle in the range of 60 to 75 degrees. Such rollers can advantageously bias a lowest mail component of a mail item to align with a side wall or the like of the collecting conveyor, in particular such that the mail item is thereby subsequently (more) aligned with the single side fold created in the flow wrap station.

It will be appreciated that such alignment means may alternatively or additionally be provided elsewhere, for example at the infeed end of the flow wrap station and/or at the at least one feeder.

DETAILED DESCRIPTION

Figure 2A:
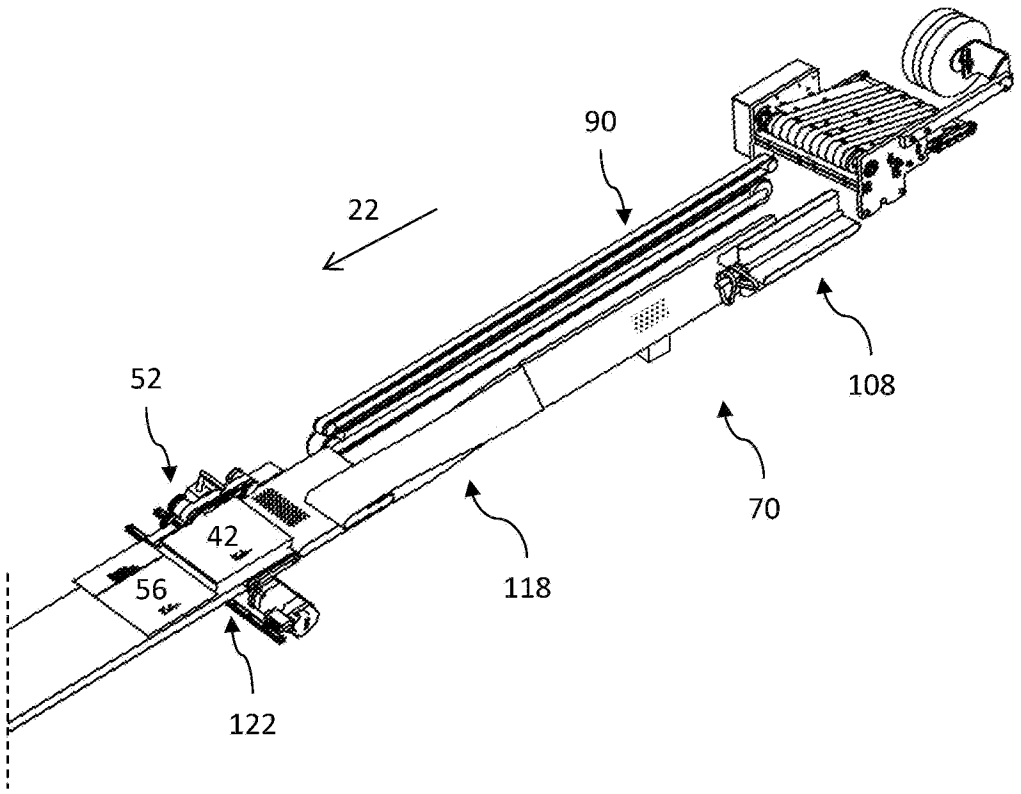
Figure 2B:
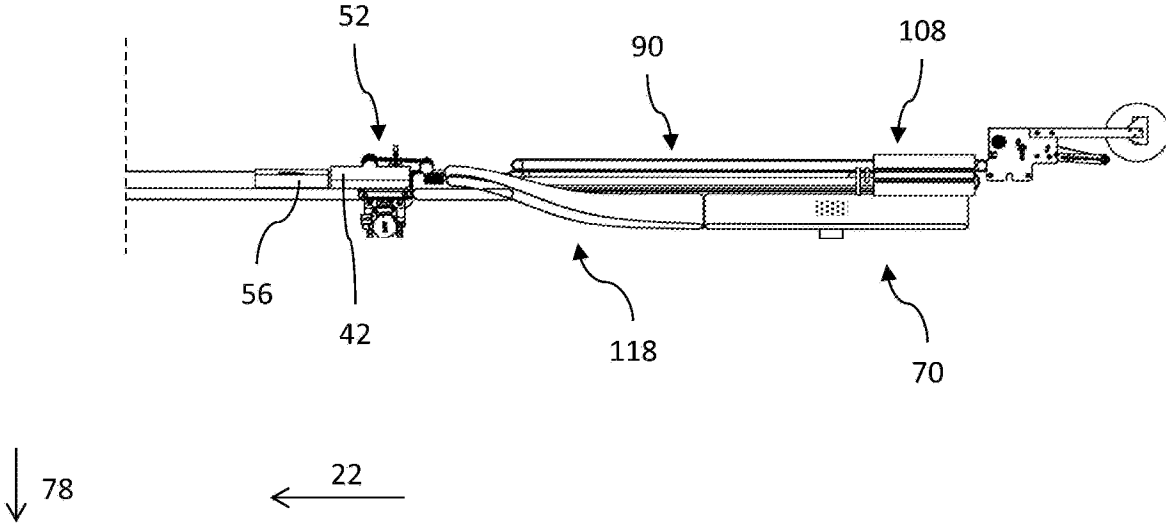
Figure 2C:
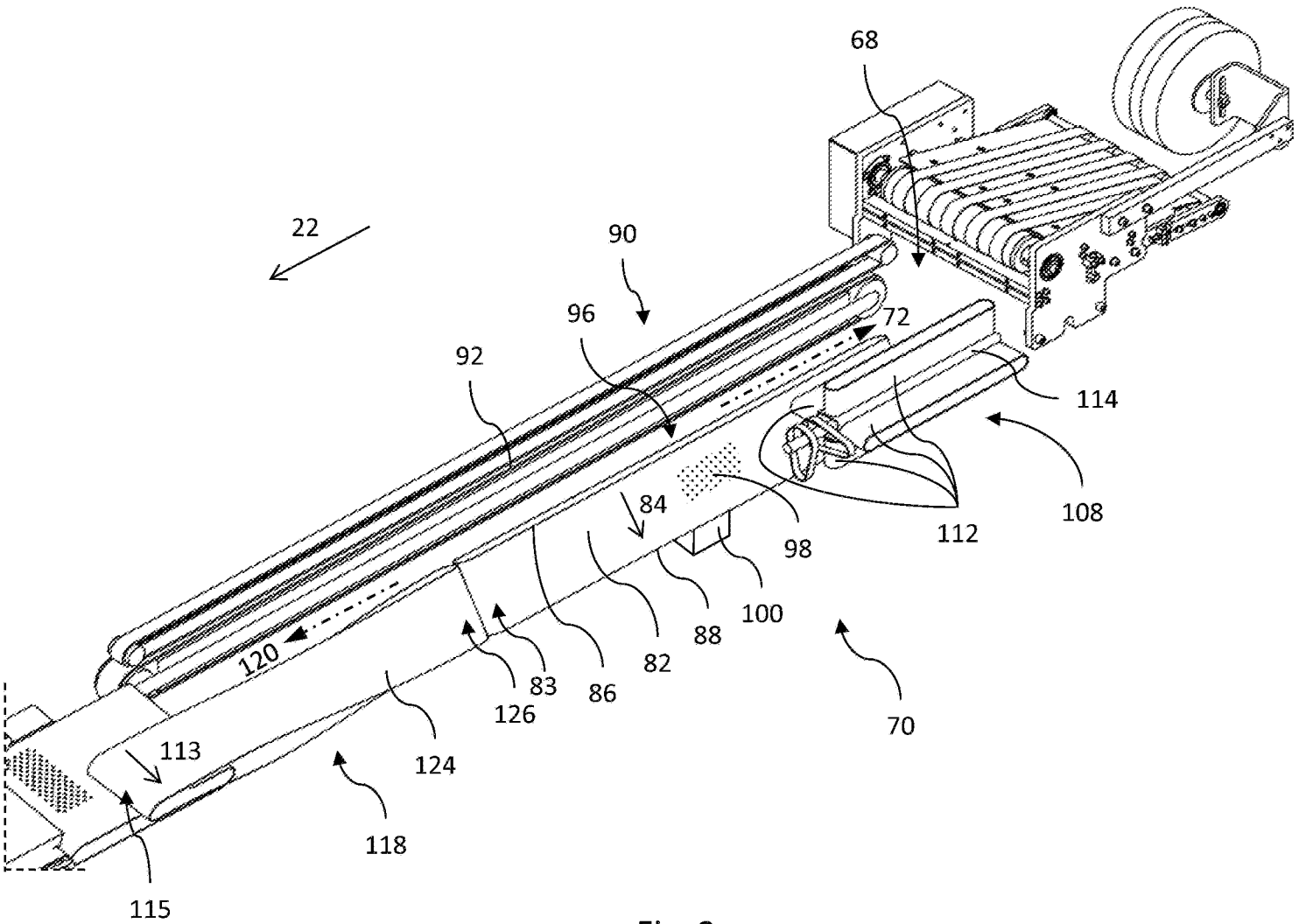
Figure 2D:
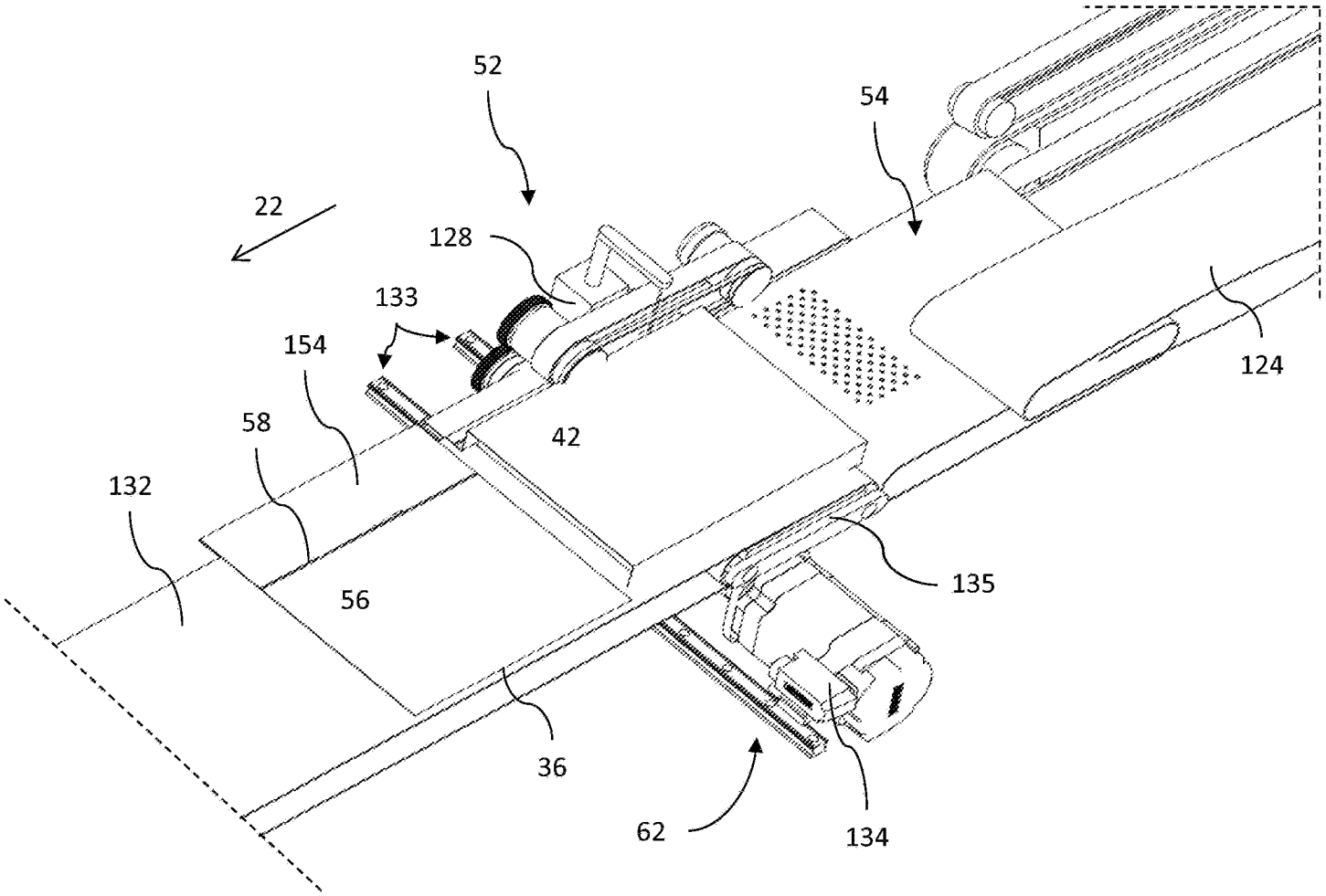

Further elaborations of the invention are described in the dependent claims and will be further elucidated with reference to examples in the following figures:

FIG. 1 shows a schematic overview of a packaging assembly of an exemplary embodiment;

FIGS. 2*a*-2*d* show views of a downstream section of an exemplary packaging assembly, wherein FIG. 2*a* is an isometric view, FIG. 2*b* is a side view, FIG. 2*c* is a first partial isometric view and FIG. 2*d* is a second partial isometric view;

FIGS. 3*a*-3*i* show an exemplary set of three subsequent mail items, wherein the different figures relate to different stages or aspects of processing according to an exemplary method and/or using an exemplary embodiment.

Figure 4:
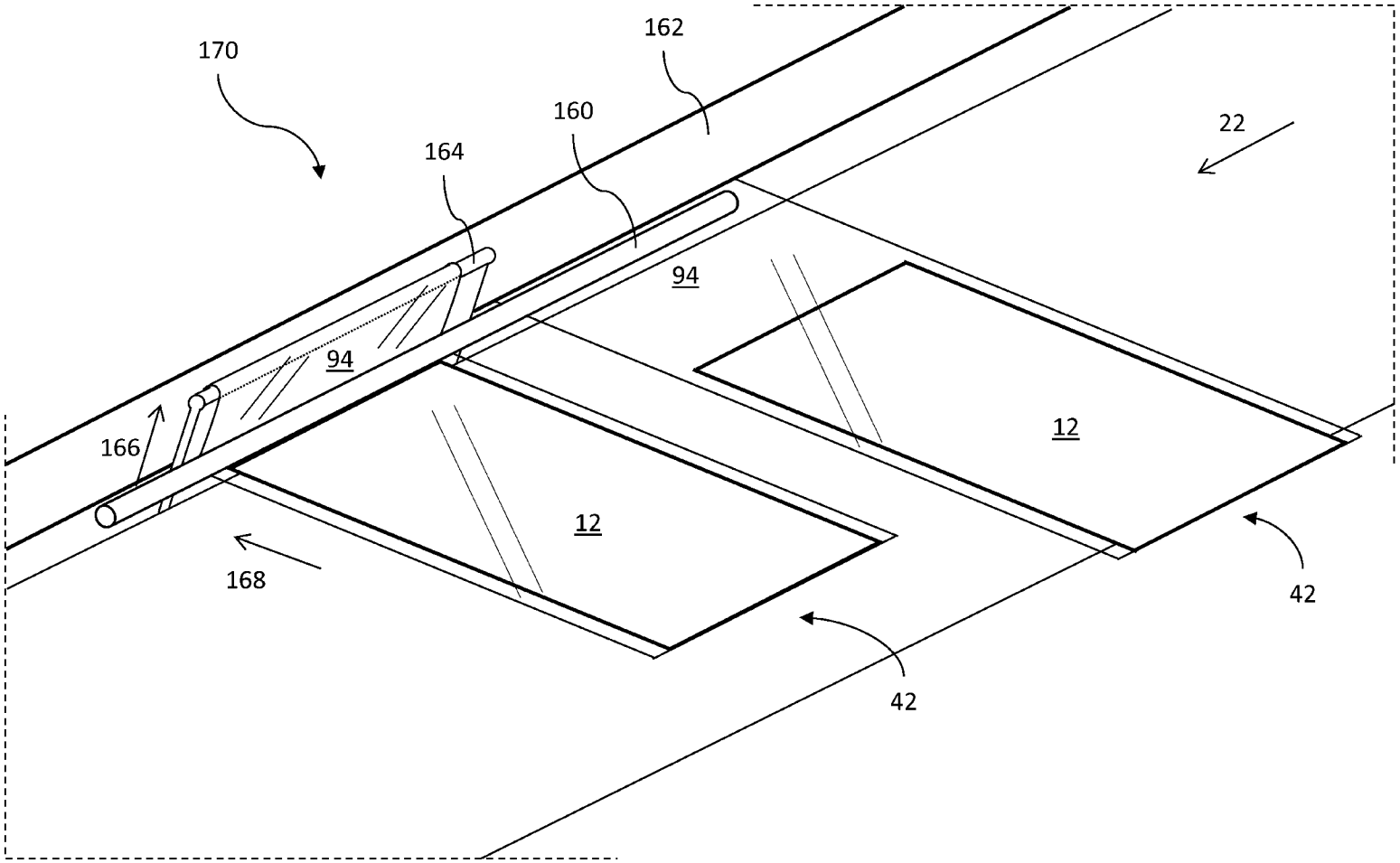

FIG. 4 shows an isometric view of an exemplary intermediate mail product transverse displacement assembly.

FIG. 1 shows a schematic overview of a packaging assembly 10 of an exemplary embodiment, the packaging assembly 10 having a transport direction 22 and comprising a mail item collecting assembly 16, a flow wrap station 26, a cross sealing assembly 40, an alignment assembly 66, a measuring assembly 48, a longitudinal sealing assembly 52 and a trimming assembly 152.

It will be appreciated that, while assemblies are shown as being positioned downstream or upstream of other assemblies along the transport direction 22, in some embodiments, the assemblies may be positioned differently and assemblies may overlap along the transport direction 22. Also, while the transport direction 22 is shown as a straight line, it may be directed along a curved and/or cornered path in some embodiments.

In the example, the mail item collecting assembly 16 includes at least one feeder 20 for dispatching individual mail components 14 to a collecting conveyor 18 having a downstream end 24. The flow wrap station 26 has an infeed end 30 which connects to the downstream end 24 of the collecting conveyor 18 and comprises a folding assembly 32. The longitudinal sealing assembly 52 may include a heat seal head 128, in particular a seal swing head. The trimming assembly 152 may be provided for removing, e.g. by means of suction, an excess web part 154 (see FIG. 3*g*) from the mail product 56 and may include a suction pump 156 having a fluid inlet 158.

FIG. 2*a* shows an isometric view of a downstream section of an exemplary packaging assembly 10 comprising a longitudinal sealing assembly 52, wherein a longitudinal seal 58 is applied in an intermediate mail product 42 and wherein a mail product 56 is downstream of the intermediate mail product 42, wherein the intermediate mail product 42 is in a third orientation 122. FIG. 2*a* further shows: a first tilting assembly 70 with a holding assembly 90 and a dispatch timing assembly 108; and a back tilting assembly 118.

FIG. 2*b* shows a side view corresponding to the isometric view of FIG. 2*a*, in which side view the downward direction of the gravitational force field is indicated by arrow 78.

In an embodiment, of which an example is shown in FIG. 2*c*, the first tilting assembly 70 comprises a tilted conveyor 82 configured for further transporting the intermediate mail product 42 substantially in the transport direction 22. A transverse slope 84 of the tilted conveyor 82 extends between an upper longitudinal side 86 of the tilted conveyor 82 and a lower longitudinal side 88 of the tilted conveyor 82. The first tilting assembly 70 additionally comprises a holding assembly 90.

Advantageously, such a tilted conveyor 82 provides means for receiving and maintaining the intermediate mail product 42 in a tilted orientation while transporting the intermediate mail product 42 further in the transport direction 22.

In an embodiment, the holding assembly 90 comprises a first clamping assembly 92 positioned along and adjacent to the upper longitudinal side 86 of the tilted conveyor 82 and configured to clamp two end flaps 94 of the associated web part 46 of the intermediate mail product 42.

Advantageously, such a holding assembly 90 provides means for holding the associated web part 46 at a controlled vertical position, e.g. a substantially constant vertical position, without directly inhibiting a downward movement of mail components 14 contained within the associated web part 46 thanks to gravity. The downward movement combined with the holding of the associated web part 46 may result in edges of mail components 14 becoming aligned to the side fold 36.

In an embodiment, of which an example is shown in FIG. 2*c*, the holding assembly 90 comprises a suction assembly 96 for holding the intermediate mail product 42 onto the tilted conveyor 82. The suction assembly 96 comprises a fluid inlet 98, a suction pump 100 having a fluid connection to the fluid inlet 98 and a fluid transmissive area of a conveyor belt of the tilted conveyor 82. The fluid inlet 98 is positioned directly below an intermediate mail product receiving area of the tilted conveyor 82. The tilted conveyor 82 is configured for passing the fluid transmissive area of the conveyor belt directly over the fluid inlet 98 and for creating a sub-atmospheric pressure between the fluid inlet 98 and the intermediate mail product 42 so as to suck the intermediate mail product 42 onto the conveyor belt.

Advantageously, such a suction assembly 96 provides for holding the associated web part 46 tightly onto the tilted conveyor 82.

Figure 3A:
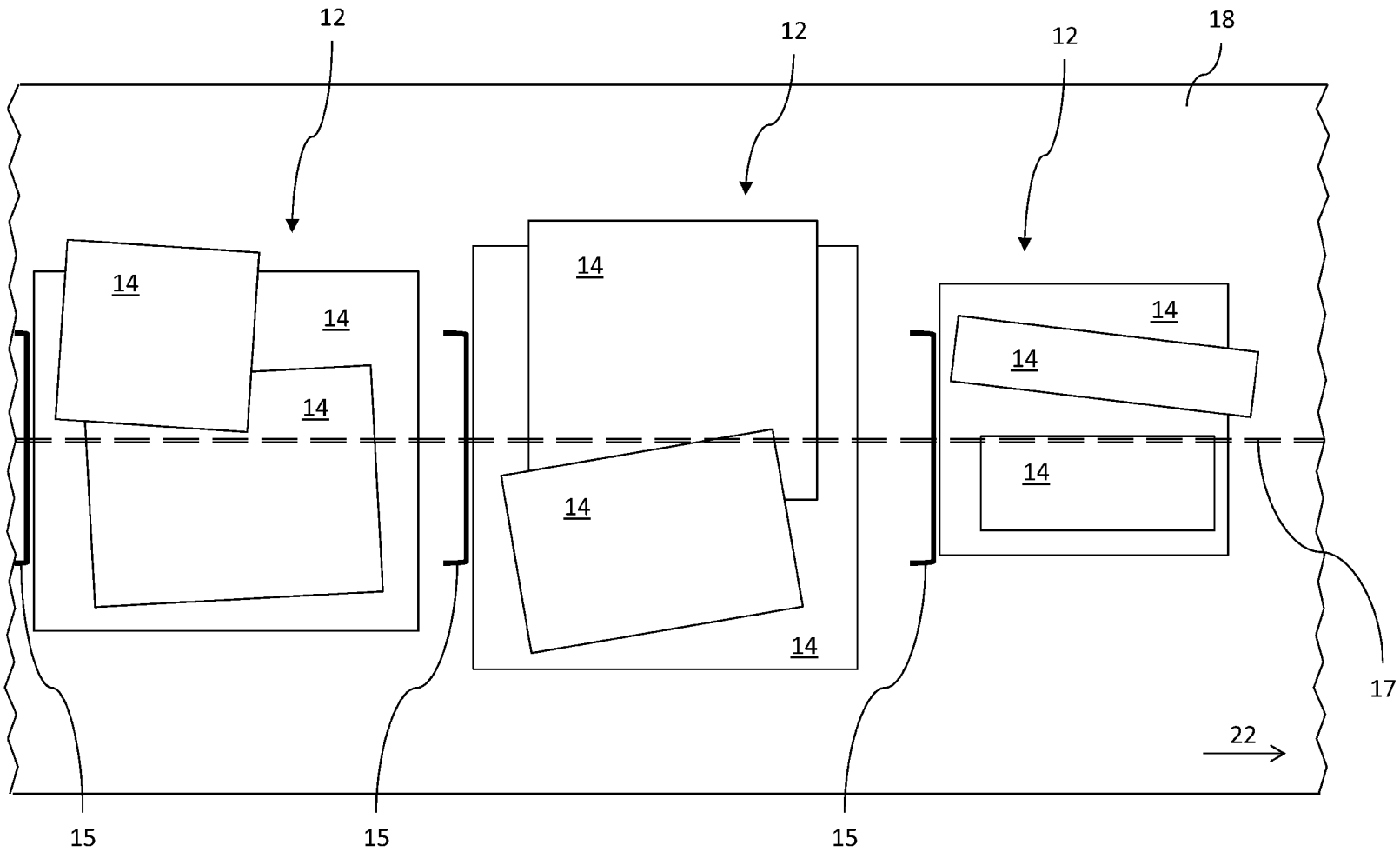
Figure 3B:
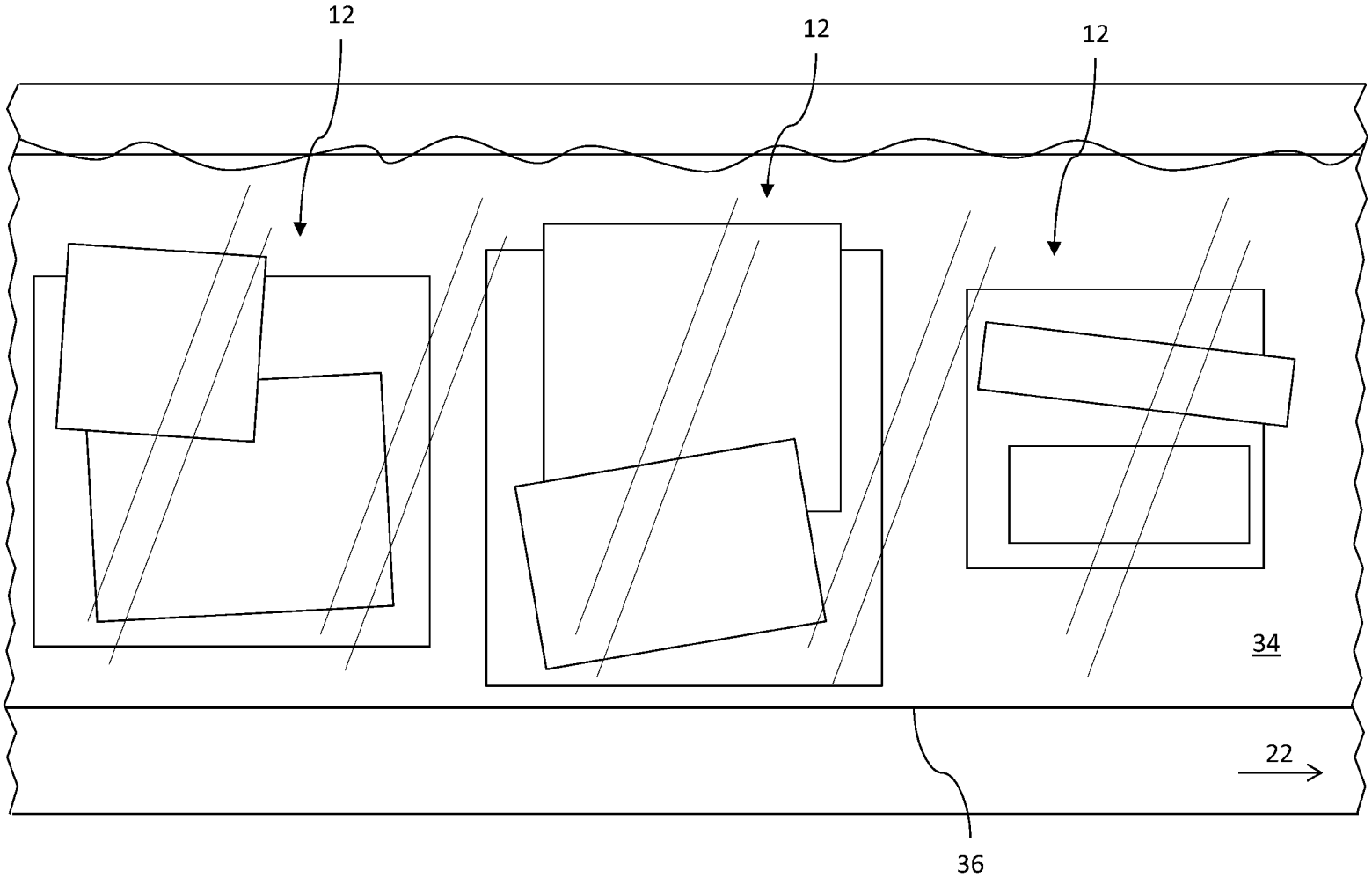
Figure 3C:
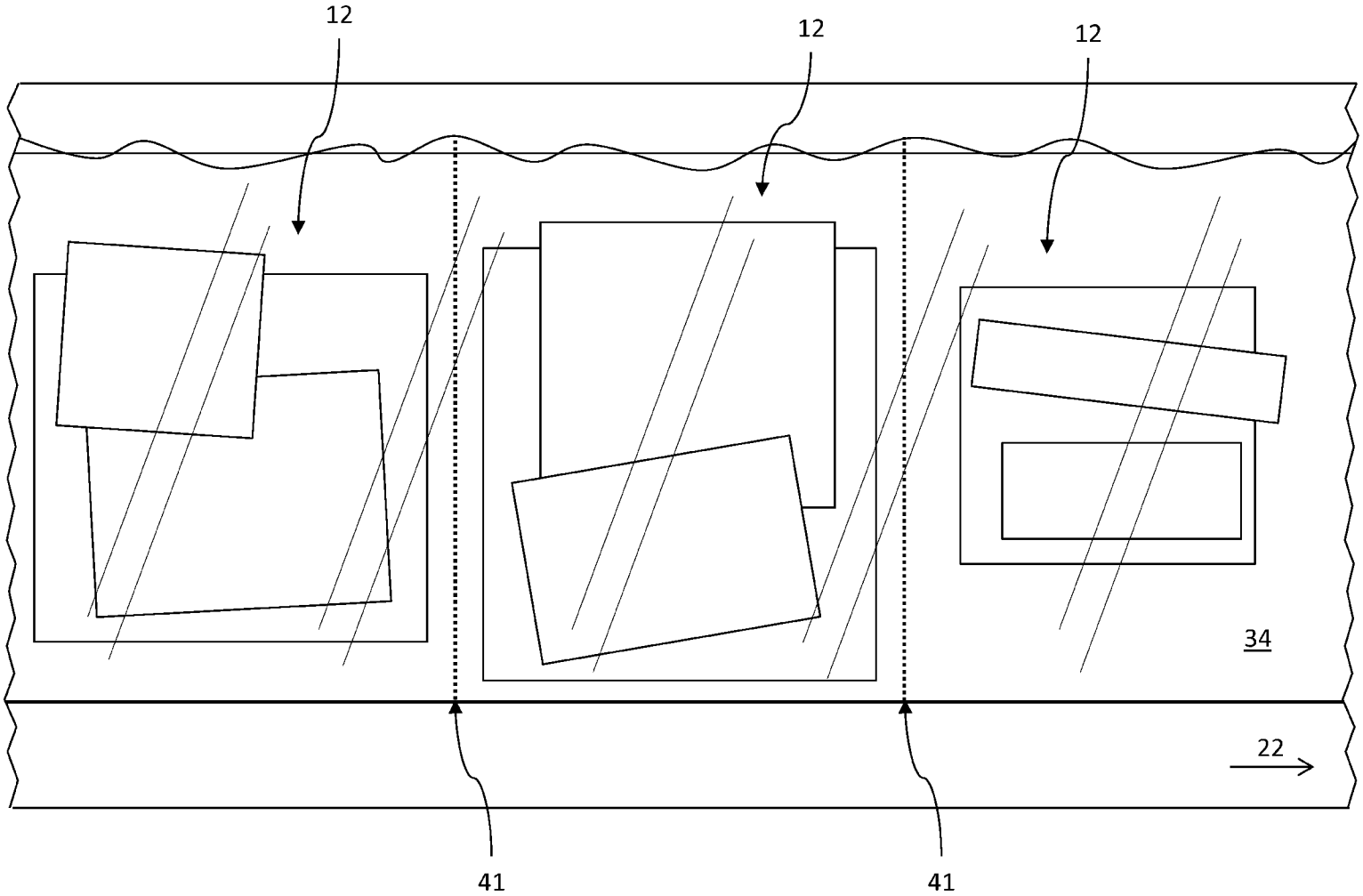
Figure 3D:
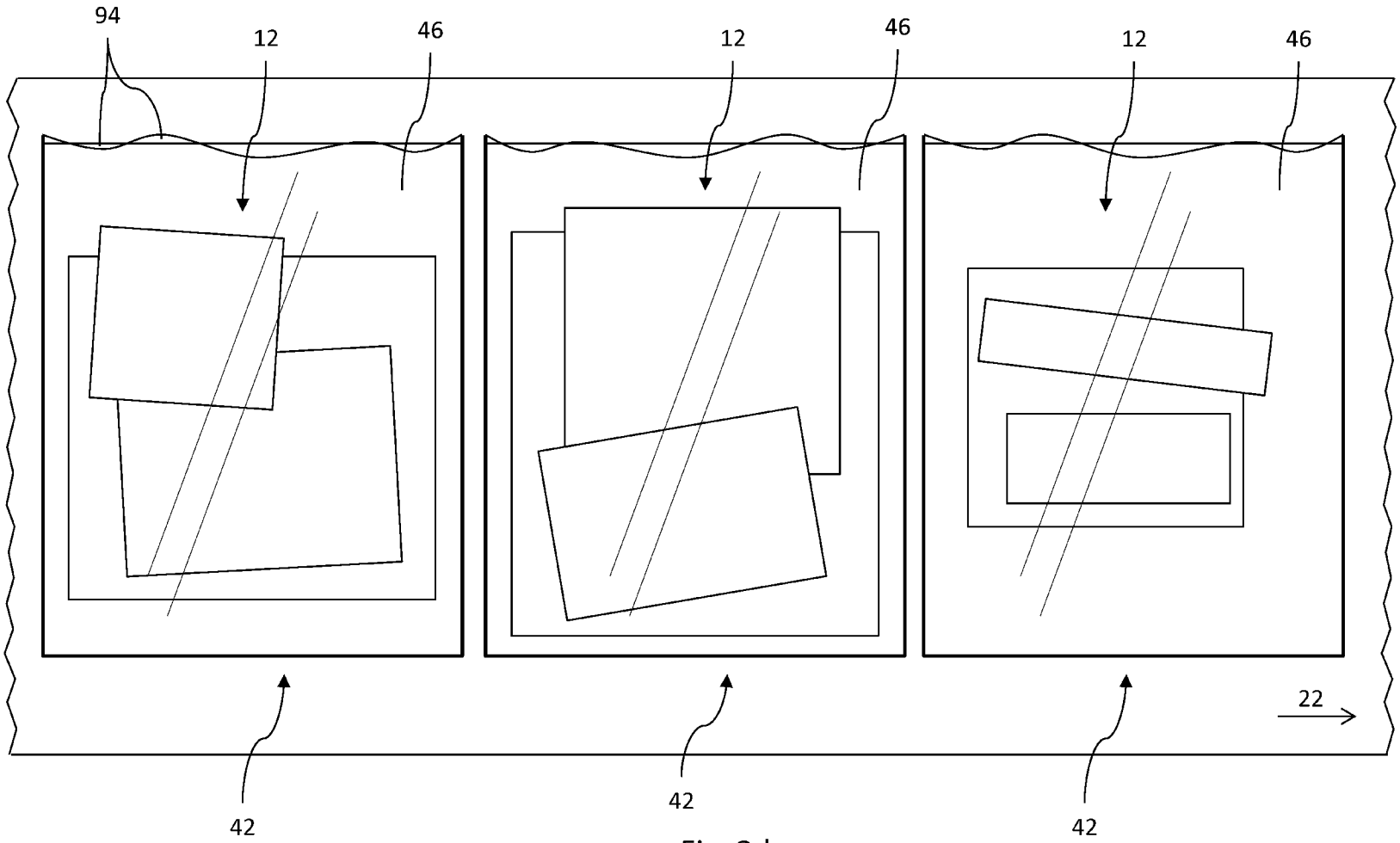
Figure 3E:
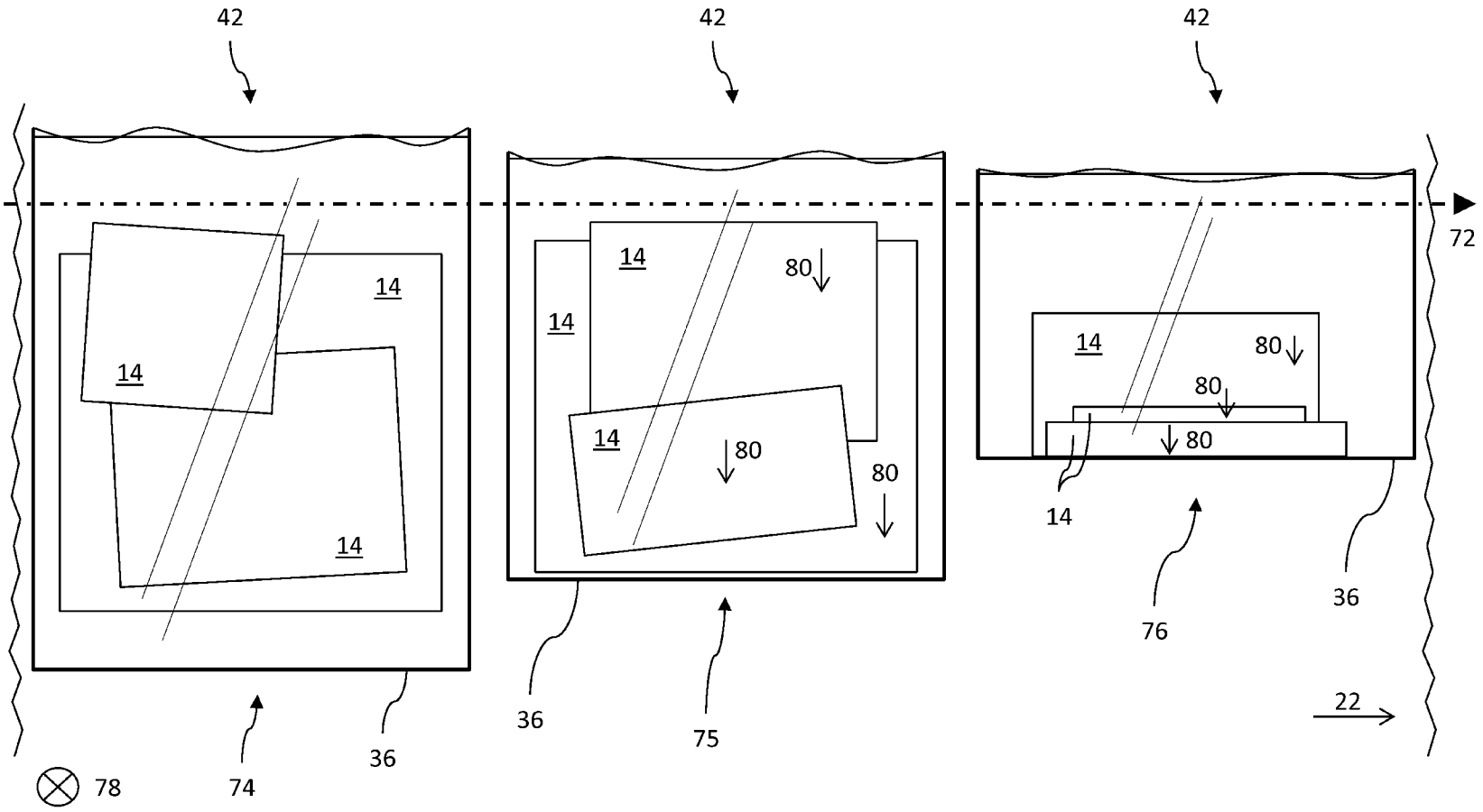
Figure 3F:
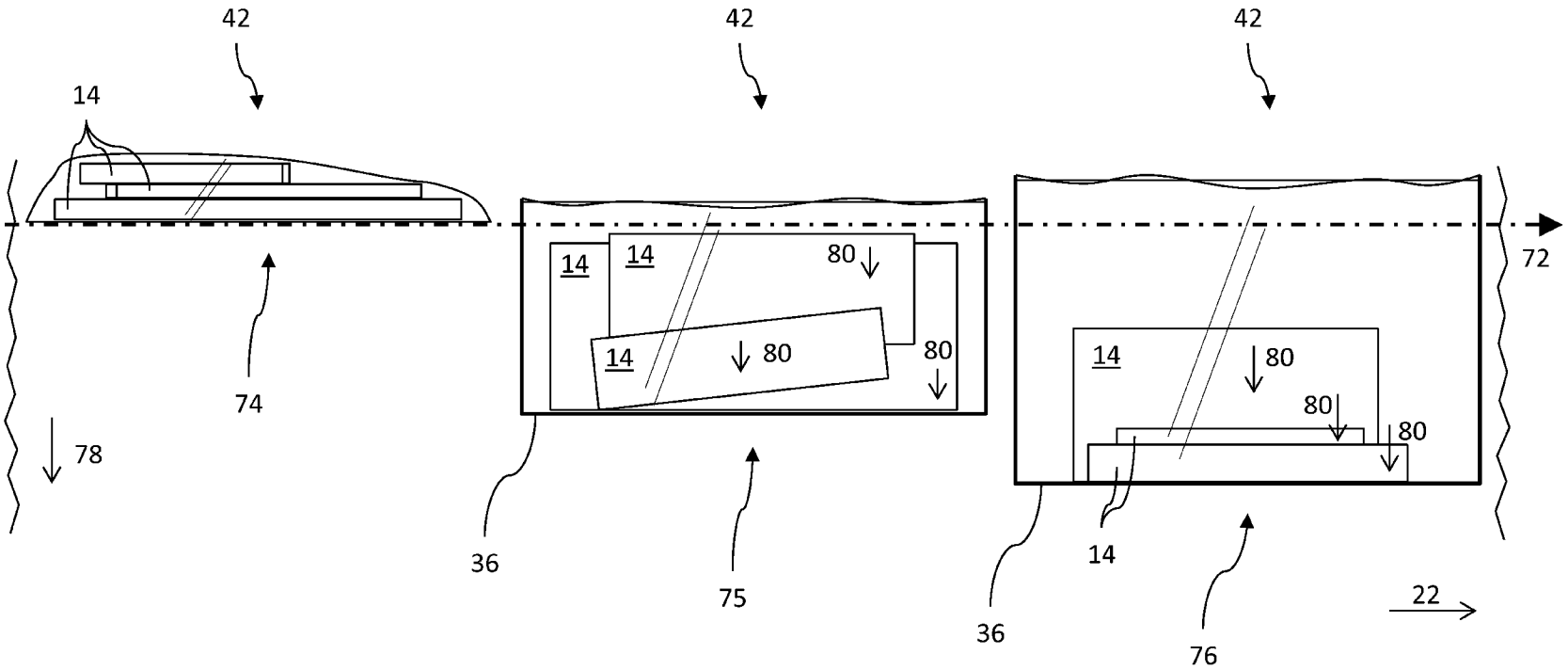
Figure 3G:
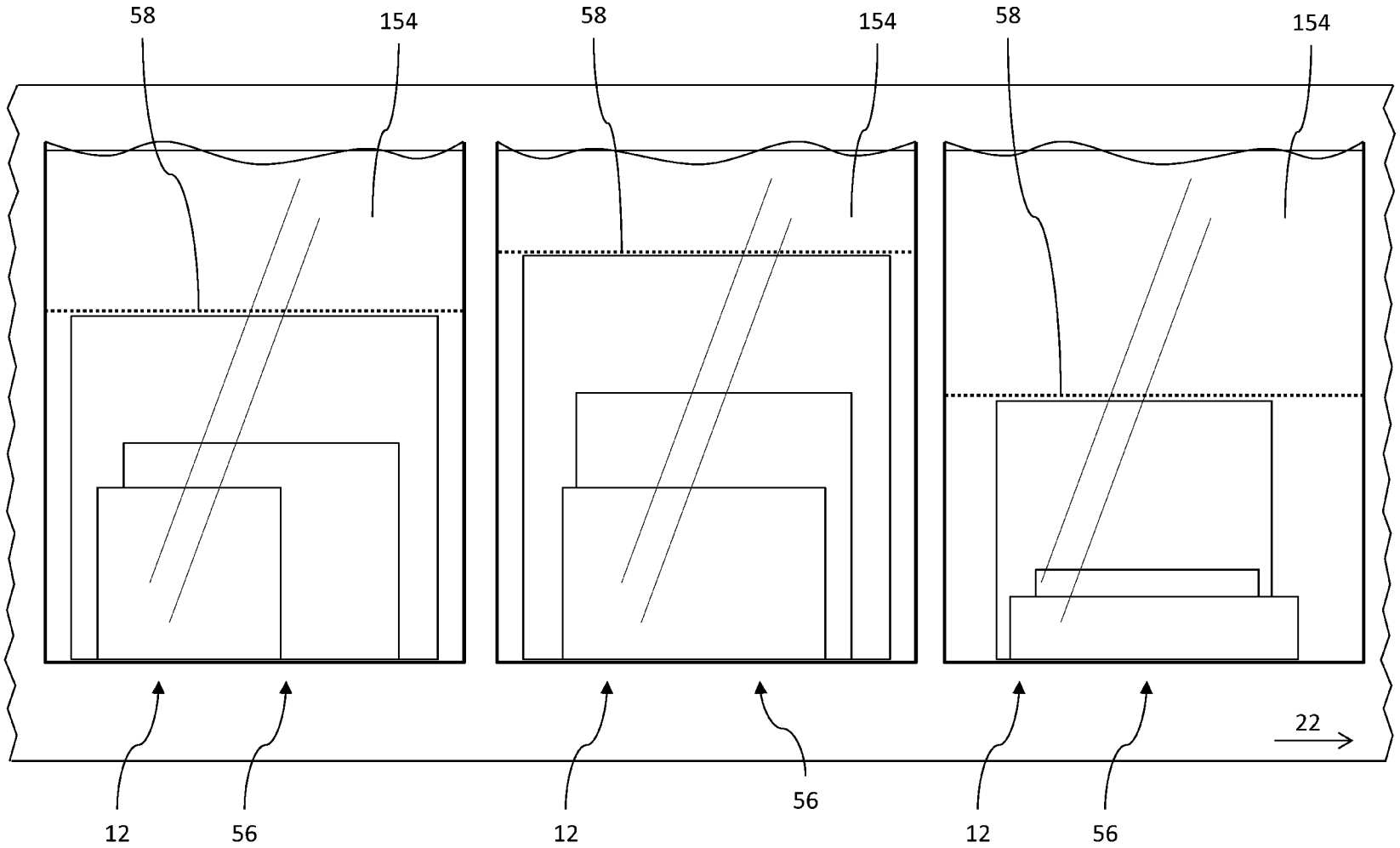

In an exemplary method with reference to FIGS. 2*a-b* as well as FIGS. 3*e* and 3*f*, an intermediate mail product 42 (comprising a mail item 12 and an associated web part 46) is received along a transport direction 22 in a first orientation 74. Specifically, the second side of the intermediate mail product 42 is received in the holding assembly 90 while the respective first side is received on the dispatch timing assembly 108. Subsequently, the second side is dropped so that the intermediate mail product 42 is received, substantially without being twisted, on the first tilting assembly 70 in the second orientation 76. A downstream back tilting assembly 118 then brings the intermediate mail product 42 to a third orientation 122 as shown in FIG. 3*g*, in which orientation a longitudinal seal 58 is applied to it in the longitudinal sealing assembly 52, resulting in a mail product 56. Further downstream, an excess web part 154 is removed from the mail product 56 in a trimming assembly 152.

FIG. 2*c* shows an examplary embodiment of the dispatch timing assembly 108 positioned at the infeed end 68 first tilting assembly 70. The dispatch timing assembly 108 comprising support surfaces 112 which are connected to a rotatable shaft 114 and extend radially outwardly from the shaft 114. The shaft 114 extends substantially in the transport direction 22. The dispatch timing assembly 108 is configured to control the tilting of each intermediate mail product 42. Preferably, each support surface 112 comprises a transport conveyor.

In an elaboration of the exemplary method, the intermediate mail product 42 is received at the infeed end 68, where its second side is clamped in the clamping assembly 92. The clamping assembly 92 may include, for example, two belts that are pressed against each other. The holding assembly 90 may further comprise a suction assembly 96 for further holding the intermediate mail product 42 onto the tilted conveyor 82 once it is received there. The fluid inlet 98 may connect to some or all of the receiving surface of the tilted conveyor 82, for instance. The transverse slope 84 of the tilted conveyor 82 preferably substantially corresponds to the second orientation 76.

In an embodiment, the method for wrapping mail items 12 comprises: providing a packaging assembly 10 according to the invention; receiving a side fold 36 of an intermediate mail product 42 on a first of the plurality of support surfaces 112 of the dispatch timing assembly 108; and releasing the side fold 36, after the receiving, by rotating the rotatable shaft 114 to move the first support surface 112 from a substantially horizontal position downwardly to a releasing position. Each support surface 112 is thus cycled through subsequent positions. E.g. in the case of four support surfaces 112, the surfaces 112 may be rotated by 90 degrees around the shaft 114 each time after receiving a subsequent intermediate mail product 42.

As the intermediate mail product 42 is brought from the first orientation 74 to the second orientation 76, its respective mail item 12 is effectively rotated around a rotation axis that is indicated by arrow 72 (see FIGS. 2*c*, 3*e* and 3*f*), wherein the arrow 72 indicates a right-handed rotation.

In an embodiment, of which an example is shown in FIG. 2*c*, the back tilting assembly 118 comprises a back tilting conveyor 124 for further transporting the intermediate mail product 42 substantially in the transport direction 22. An infeed end 126 of the back tilting conveyor 124 is positioned downstream of an outfeed end 83 of the first tilting assembly 70. A transverse slope 113 of at least an outfeed end 115 of the back tilting conveyor 124 is small compared to the transverse slope 84 of the tilted conveyor 82. A transverse slope of the infeed end 126 may be substantially corresponding to a transverse slope 84 of the first tilting assembly 70.

The back tilting conveyor 124 is thus advantageously configured to bring an intermediate mail product 42 from a second orientation 76 to a third, more horizontal orientation, wherein the transverse slope 113 of the outfeed end 115 preferably corresponds to the third orientation 122.

As the intermediate mail product 42 is brought from the second to the third orientation 122, its respective mail item 12 is effectively rotated around a rotation axis that is indicated by arrow 120 (see FIG. 2*c*), wherein the arrow 120 indicates a right-handed rotation.

FIG. 2*d* shows a second partial isometric view of the section shown in FIGS. 2*a*-2*b*, showing an example of the longitudinal sealing assembly 52. The longitudinal sealing assembly 52 comprises an infeed end 54 and a longitudinal sealing conveyor 132. Further, a transverse guide 133 is provided together with a carriage 135 to which the longitudinal sealing conveyor 132 and the heat seal head 128 are connected. A transverse actuator 134 is provided for moving the carriage 135 along the transverse guide 133. The combination of at least the guide 133 and the carriage 135 may form a positioning assembly 62 for controlling a transverse position of the longitudinal seal 58 for each intermediate mail product 42.

In an embodiment, the method for wrapping mail items 12 comprises: providing a packaging assembly 10 according to the invention; and creating a mail product 56 by applying the longitudinal seal 58 in an intermediate mail product 42 which is received on the longitudinal sealing conveyor 132 while moving the carriage 135 with the longitudinal sealing conveyor 132 and the heat seal head 128 along the transverse guide 133 for positioning these at a transverse position corresponding to a transverse position of a longitudinal seal 58 determined for an intermediate mail product 42 directly upstream of the longitudinal sealing conveyor 132.

Thus, in a further elaboration of the exemplary method, an intermediate mail product 42 is received in the third orientation 122 at an infeed end 54 of the longitudinal sealing assembly 52. In dependence of a transverse position of the second side of the mail item 12, as determined by a measuring assembly 48, the longitudinal sealing conveyor 132 and the heat seal head 128 are moved to an appropriate receiving transverse position using the transverse guide 133 and the carriage 135, so that e.g. the second side of the mail item 12 is received at a transverse position substantially corresponding to a transverse position of the heat seal head 128. A longitudinal seal 58 is then applied by the heat seal head 128 in the received intermediate mail product 42. While the longitudinal seal 58 is being applied, the heat seal head 128 and the longitudinal sealing conveyor 132 may already be moved to an appropriate transverse position for receiving a subsequent intermediate mail product 42 so as to minimize delays and improve throughput.

In an embodiment, the packaging assembly 10 may comprise a trimming assembly 152 configured to remove an excess web part 154 from the mail product 56, the excess web part 154 being a part or parts of the associated web part 46. The excess web part 154 is located at a side of the longitudinal seal 58 opposite to the mail item 12. The trimming assembly 152 forms part of or is located downstream of the longitudinal sealing assembly 52.

Advantageously, such a trimming assembly 152 provides means for creating a mail product 56 that is free from excess web parts 154.

In an embodiment, the trimming assembly 152 includes a suction pump 156 having a fluid inlet 158, wherein the trimming assembly 152 is configured to create a sub-atmospheric pressure between the fluid inlet 158 and the excess web part 154 so as to suck the excess web part 154 away from the mail product 56.

Advantageously, such a trimming assembly 152 enables that the excess web part 154 is effectively, efficiently and safely removed.

Alternatively and/or additionally, the trimming assembly 152 may be configured to remove the excess web part 154 from the mail product 56 through clamping and/or pulling, e.g. using one or more belts, of the excess web part 154, in particular through pulling the excess web part 154 away from the mail product 56.

The measuring assembly 48 may be realized in various ways, including the use of optical (e.g. camera) systems, among other known alternatives. As a particularly basic alternative, the measuring assembly 48 may comprise a computer system having a user interface for manually entering a dimension (e.g. a cross width) of a mail component 14 that is being dispatched by a feeder 20, based on which the transverse position of the second side of the mail item 12 is determined in the computer system. However, e.g. in the exemplary embodiment, the transverse position of the second side of the mail item 12 is preferably measured after the sides of the mail components 14 have been aligned in the alignment assembly 66.

FIGS. 3*a*-3*i* show a set of three subsequent exemplary mail items, 12 wherein the different figures relate to different stages or aspects of processing according to an exemplary method and/or using an exemplary embodiment.

FIG. 3*a* shows three subsequent mail items 12 being transported on a collecting conveyor 18 in a transport direction 22, wherein each mail item 12 includes mail components 14, which have generally different dimensions within and between mail items 12. In this example, each mail item 12 is composed of three mail components 14. However, the number of mail components 14 within a mail item 12 may vary between mail items 12 and may be lower or higher than three. Preferably, the mail items 12 are advanced in the transport direction 22 by projections 15 that are connected to an endless chain 17 that is driven.

FIG. 3*b* shows that a folded web 34 has been created around the mail items 12, wherein the folded web 34 has a side fold 36 extending in the transport direction 22 and positioned on a first side of the mail items 12. In this example, the web consists of a transparent foil.

FIG. 3*c* shows cross seals 41 in the folded web 34 having been created between 41 the mail items 12.

FIG. 3*d* shows that the folded web 34 has been separated into discrete intermediate mail products 42 comprising the mail items 12 and their associated web parts 46, wherein each web part 46 comprises two end flaps 94.

In some embodiments, applying the cross seal 41 and separating a downstream intermediate mail product 42 may be combined in a substantially single operation, e.g. using a seal head with an integrated cutting device or by cross sealing and simultaneously pulling a downstream product away from the upstream product.

FIG. 3*e* shows a top view of intermediate mail products 42 being tilted in a first tilting assembly 70 around an axis of rotation 72 from a first orientation 74 to a second orientation 76, preferably moving through an intermediate orientation 75. The axis of rotation 72 extends in the transport direction 22. The second orientation 76 is a substantially less horizontal orientation compared to the first orientation 74. In the second orientation 76, the gravity force exerted on the individual mail components 14 has a force component 80 which is directed towards the side fold 36. In the top view of FIG. 3*e*, the downward direction of the gravitational force field is directed into the surface of the drawing as indicated by arrow 78 in FIG. 3*e*.

FIG. 3*f* shows a side view corresponding to the top view of FIG. 3*e*. In the side view of FIG. 3*f*, the downward direction of the gravitational force field is as indicated by arrow 78.

In FIGS. 3*e-f*, sides of mail components 14 of the mail item 12 in the second orientation 76 are shown to be aligned along and adjacent to the side fold 36, whereas they were not so aligned before the tilting, as shown in e.g. FIG. 3*d*. Meanwhile, sides of mail components 14 of the mail item 12 in the intermediate orientation 75 are in the process of becoming so aligned as the mail item 12 is being tilted from the first orientation 74 to the second orientation 76 and the gravity force component 80 directed towards the side fold 36 increases from substantially zero in the first orientation 74 to substantially nonzero in the second orientation 76.

FIGS. 3*e-f* show that one intermediate mail product 42 is in a second orientation 76 while a second upstream intermediate mail product 42 is in a first orientation 74. It will be appreciated that this is not meant as limiting the invention but merely to show subsequent orientations in a concise manner. Depending on further details of embodiments, such distances between intermediate mail products 42 may be larger or smaller.

It will also be appreciated that force components 80 can be thought of as acting on the centers of gravity of mail components 14, irrespective of the exact locations where arrows 80 are positioned in the drawings. Dimensions of arrows 80 are not meant to confer an exact size of the force components 80.

FIG. 3*g* shows mail products 56 having been created by applying a longitudinal seal 58 in each intermediate mail product 42, wherein the transverse position of the longitudinal seal 58 is determined by the transverse position of the second side of the respective mail item 12. An excess web part 154 is shown for each mail product 56, wherein the excess web part 154 is located at a side of the longitudinal seal 58 opposite to the mail item 12.

In FIG. 3*g*, the side folds 36 of the mail products 56 are shown to be aligned to each other. In some embodiments, however, the transverse positions of the longitudinal seals 58 may be aligned to each other at this stage, whereby the side folds 36 may not be aligned any longer.

Figure 3H:
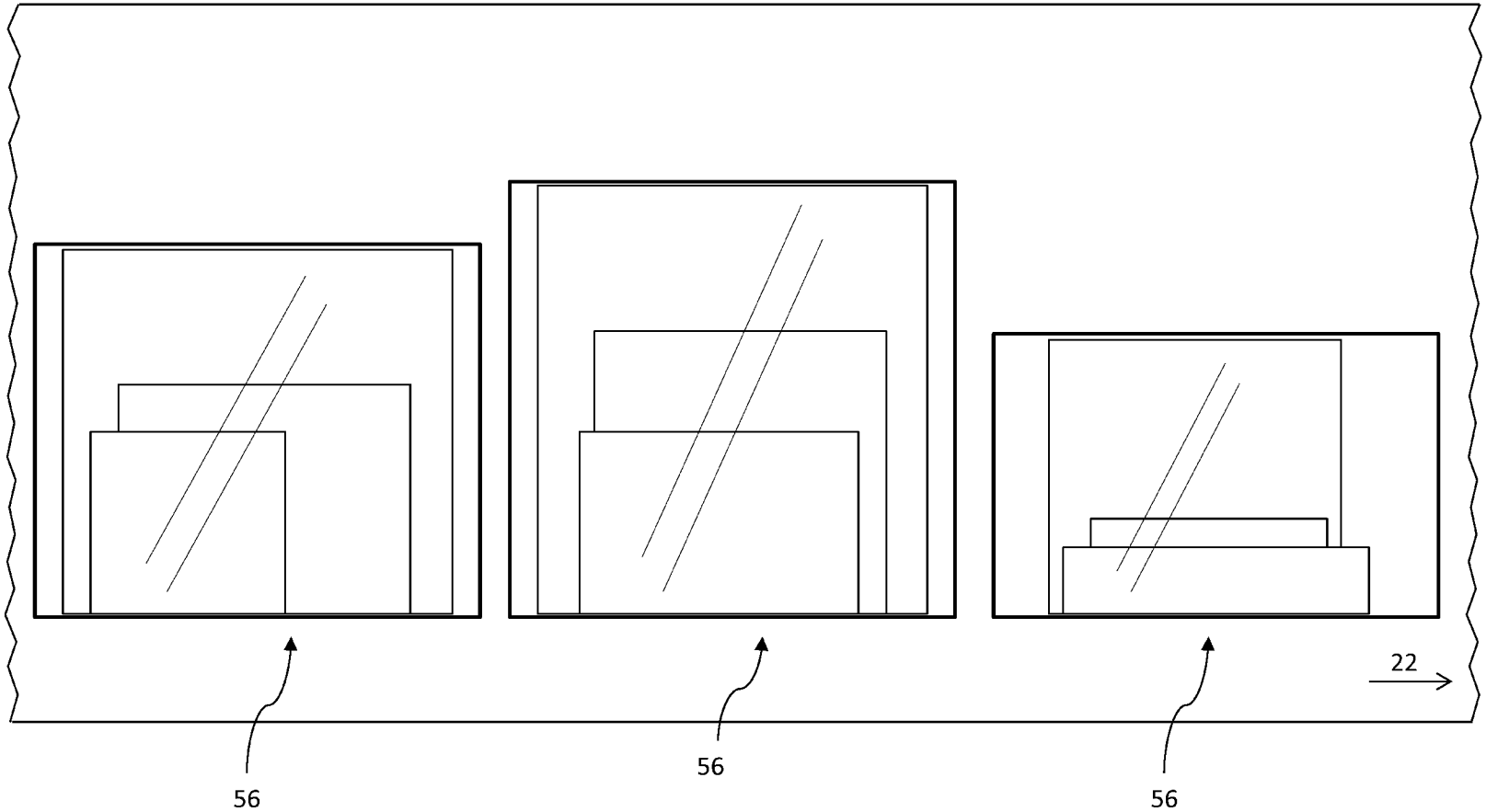

FIG. 3*h* shows the respective mail products 56 after their excess web parts 154 (not shown in FIG. 3*h*) have been removed, resulting in mail products 56 of varying widths that are tightly wrapped in the transverse direction.

Figure 3I:
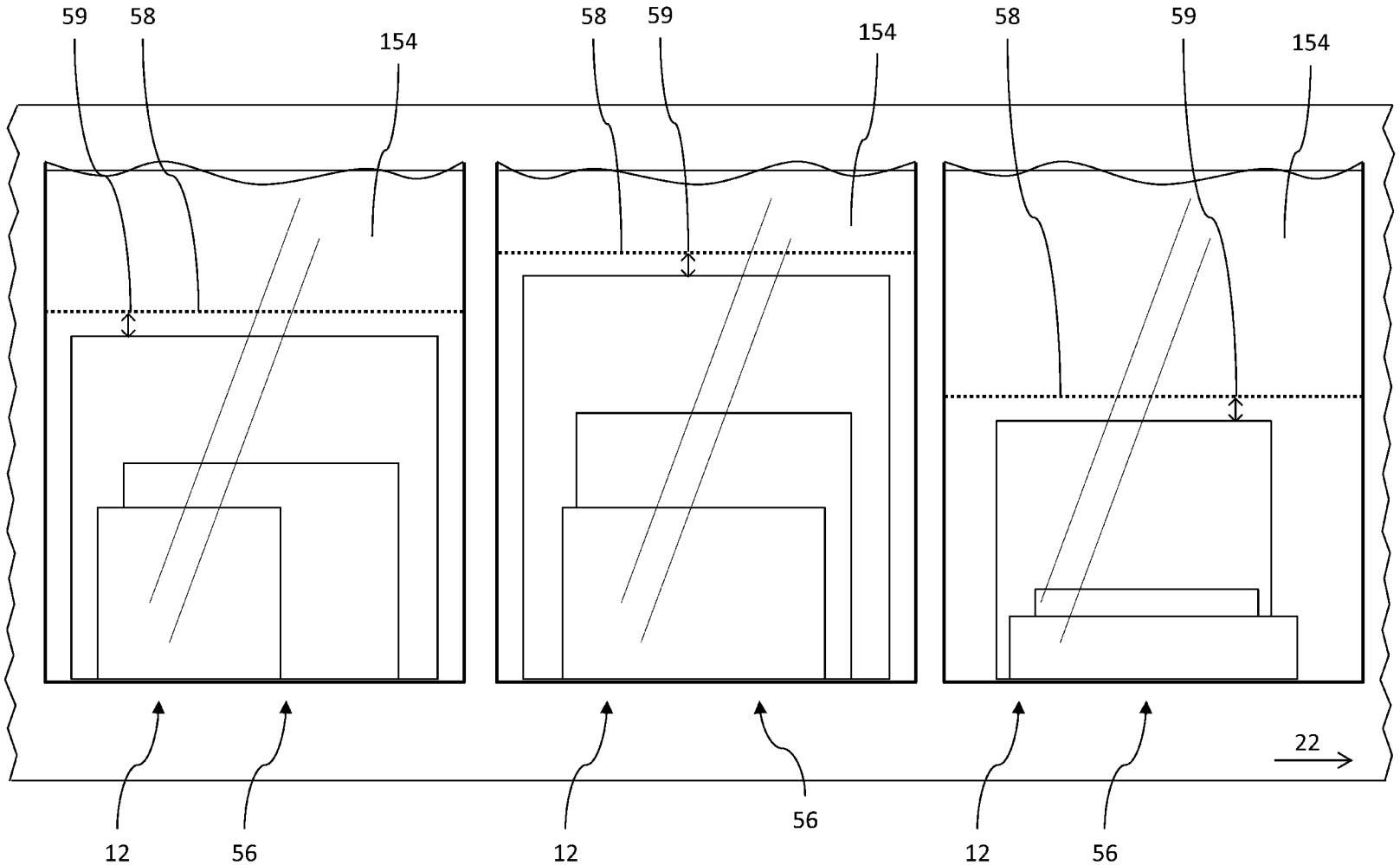

In an embodiment, as shown in FIG. 3*i*, determining the transverse position of the longitudinal seal 58 for each intermediate mail product 42 may comprise: receiving, for example through a user interface of the packaging assembly 10, a desired transverse offset 59 between the longitudinal seal 58 of the intermediate mail product 42 and the second side of the respective mail item 12; and determining the transverse position of the longitudinal seal 58 for the intermediate mail product 42 based on, in particular by summation of, the transverse position of the second side of the respective mail item 12 and the desired transverse offset 59.

In this way, a tightness of the wrapping and/or a size of the mail product relative to the respective mail item can be adjusted e.g. according to a customer preference, wherein some customers may prefer a somewhat less tightly packaged mail product and/or a mail product having a particular offset or a particular minimal offset between the second side of the respective mail item and the longitudinal seal.

FIG. 4 shows an isometric view of an exemplary intermediate mail product transverse displacement assembly 170 configured to move a respective intermediate mail product 42 in a direction 168 transverse to the transport direction 22. The intermediate mail product transverse displacement assembly 170 is preferably positioned upstream of the heat seal head 128 which has a substantially fixed position.

In the example, the intermediate mail product transverse displacement assembly 170 is shown to include a guide 160, for example a rod or a roller, positioned along the transport direction 22 at a transverse position substantially corresponding to a transverse position of the heat seal head 128, i.e. a transverse position substantially corresponding to a desired transverse position of the second side of the mail item 12.

The guide 160 is thus configured for restricting a passage for two end flaps 94 of the associated web part 46, wherein the passage is substantially narrow with respect to a thickness of the mail item 12.

A second clamping assembly 162 configured to clamp the two end flaps 94, is preferably positioned at a side of the guide 160 opposite from the mail item 12.

A push bar 164 is positioned in between the guide 160 and the second clamping assembly 162 and configured to push the two end flaps 94 in between the guide 160 and the second clamping assembly 162 in an outward direction 166 from the plane between the guide 160 and the second clamping assembly 162 so as to pull the two end flaps 94 through the passage thereby repositioning the mail item 12 relative to the heat seal head 128.

Thus, advantageously, the second side of the mail item 12 is pulled against the guide 160, wherein the transverse position of the guide 160 substantially corresponds to the transverse position of the downstream heat seal head 128.

The push bar 164 may be controlled to ensure appropriate repositioning through appropriate outward displacement, in particular an appropriate end position of the push bar 164, for each intermediate mail product 42, in dependence of the transverse position of the second side of the mail item 12.

In some embodiments, the appropriate end position may be determined depending on an initial transverse position of the second side of the mail item 12 as determined by an upstream measurement assembly (not shown).

Alternatively, the appropriate end position may be determined by measuring a displacement resistance of the push bar 164, wherein an increased displacement resistance is associated with the second side of the mail item 12 being pulled against the guide 160. Thus, detection of such an increased displacement resistance may be used to control, particularly limit, e.g. end, a further outward displacement of the push bar 164.

In an embodiment, the push bar 164 may be a first push bar of an array of push bars of the packaging assembly 10, wherein the array includes at least a second push bar (not shown) downstream of the first push bar, wherein the second push bar may be positioned in between the guide 160 and the second clamping assembly 162 and configured to push the two end flaps 94 in between the guide 160 and the second clamping assembly 162 in an outward direction 166 from the plane between the guide 160 and the second clamping assembly 162 so as to cause tension in the two end flaps 94 and/or elsewhere in the associated web part 46, in particular during application of the longitudinal seal 58, wherein the second push bar may form part of the longitudinal sealing assembly 52.

Such tensioning can improve the quality and efficiency of the process of applying the longitudinal seal and the quality of the resulting longitudinal seal. While such tensioning may be achieved using a single push bar 164, the use of a second push bar can enable more efficient wrapping of mail items, in particular by enabling a reduction of a distance between mail items in the transport direction. For example, an upstream mail item may be processed at the first push bar while a downstream mail item is processed at the second push bar.

The invention is not limited to the described examples. It will be appreciated by the skilled person that the invention may be carried out using appropriate variations of the described embodiments. The reference numbers in the claims and the detailed description do not limit the scope of the claims and the detailed description to the examples shown in the figures.

The invention claimed is:

1. A packaging assembly for wrapping mail items of differing sizes, each mail item including at least one mail component or a stack of mail components, the packaging assembly comprising:

a mail item collecting assembly including a collecting conveyor and at least one feeder for dispatching individual mail components to the collecting conveyor so as to compose the mail items which are subsequently transported in a transport direction to a downstream end of the collecting conveyor;

a flow wrap station which is configured for wrapping a continuous web of material around the mail items, wherein the flow wrap station has an infeed end which connects to the downstream end of the collecting conveyor for subsequently placing on the continuous web the mail items composed in the collecting assembly, wherein the flow wrap station comprises a folding assembly configured to continuously fold the web around the mail items, thereby creating a folded web which has a single side fold which is positioned on a first side of the subsequently placed mail items, wherein the side fold extends in the transport direction;

a longitudinal sealing assembly for creating a longitudinal seal;

a cross sealing assembly which is positioned downstream of the folding assembly and is configured for cross sealing the folded web between the subsequently placed mail items and for separating from the folded web an intermediate mail product comprising a downstream mail item of the subsequently placed mail items and an associated web part; and a measuring assembly for determining a transverse position of a second side of the mail item which is opposite the first side, wherein the longitudinal sealing assembly has an infeed end which is positioned downstream of the cross sealing assembly, wherein the longitudinal sealing assembly is configured for creating a mail product by applying a longitudinal seal to each intermediate mail product at the second side of the mail item, wherein the longitudinal sealing assembly comprises a positioning assembly for controlling a transverse position of the longitudinal seal for each intermediate mail product, and wherein the transverse position of the longitudinal seal is determined by the transverse position of the second side of the mail item;

an alignment assembly having an infeed end positioned upstream of the longitudinal sealing assembly and downstream of the cross sealing assembly, wherein the alignment assembly is configured to move the individual mail components of the mail item to cause alignment of edges of the individual mail components of the mail item along and adjacent to the side fold, wherein the alignment assembly comprises a first tilting assembly configured to tilt the intermediate mail product around an axis of rotation from a first orientation to a second orientation, wherein the axis of rotation extends in the transport direction, wherein the second orientation is a less horizontal orientation compared to the first orientation, and wherein, in the second orientation, a gravity force exerted on the individual mail components has a force component which is directed towards the side fold.

2. The packaging assembly according to claim 1, wherein the infeed end of the alignment assembly is positioned upstream of the measuring assembly.

3. The packaging assembly according to claim 1, wherein the first tilting assembly comprises:

a tilted conveyor configured for further transporting the intermediate mail product in the transport direction, wherein a transverse slope of the tilted conveyor extends between an upper longitudinal side of the tilted conveyor and a lower longitudinal side of the tilted conveyor; and a holding assembly.

4. The packaging assembly according to claim 3, wherein the holding assembly comprises:

a first clamping assembly positioned along and adjacent to the upper longitudinal side of the tilted conveyor and configured to clamp two end flaps of the associated web part of the intermediate mail product.

5. The packaging assembly according to claim 3, wherein the holding assembly comprises:

a suction assembly for holding the intermediate mail product onto the tilted conveyor, wherein the suction assembly comprises a fluid inlet, a suction pump having a fluid connection to the fluid inlet and a fluid transmissive area of a conveyor belt of the tilted conveyor, wherein the fluid inlet is positioned directly below an intermediate mail product receiving area of the tilted conveyor, and wherein the tilted conveyor is configured for passing the fluid transmissive area of the conveyor belt directly over the fluid inlet and for creating a sub-atmospheric pressure between the fluid inlet and the intermediate mail product so as to suck the intermediate mail product onto the conveyor belt.

6. The packaging assembly according to claim 1, wherein the first tilting assembly comprises:

a dispatch timing assembly positioned at an infeed end of the first tilting assembly, configured to control the tilting of each intermediate mail product, wherein the dispatch timing assembly comprises a plurality of support surfaces connected to a rotatable shaft and extending radially outwardly from the shaft, and wherein the shaft extends in the transport direction.

7. The packaging assembly according to claim 6, wherein each support surface of the dispatch timing assembly comprises a transport conveyor for guiding each intermediate mail product in the transport direction.

8. The packaging assembly according to claim 3, wherein the alignment assembly further comprises:

a back tilting assembly positioned downstream of the first tilting assembly, wherein the back tilting assembly is configured to tilt the intermediate mail product around a second axis of rotation from the second orientation to a third orientation, wherein the second axis of rotation extends in the transport direction, and wherein the third orientation is a more horizontal orientation compared to the second orientation.

9. The packaging assembly according to claim 8, wherein the back tilting assembly comprises:

a back tilting conveyor for further transporting the intermediate mail product in the transport direction, wherein an infeed end of the back tilting conveyor is positioned downstream of an outfeed end of the first tilting assembly, and wherein a transverse slope of at least an outfeed end of the back tilting conveyor is small compared to the transverse slope of the tilted conveyor.

10. The packaging assembly according to claim 1, comprising:

a trimming assembly configured to remove an excess web part from the mail product, the excess web part being a part of the associated web part, wherein the excess web part is located at a side of the longitudinal seal opposite to the mail item, and wherein the trimming assembly forms part of or is located downstream of the longitudinal sealing assembly.

11. The packaging assembly according to claim 10, wherein the trimming assembly includes a suction pump having a fluid inlet, and wherein the trimming assembly is configured to create a sub-atmospheric pressure between the fluid inlet and the excess web part so as to suck the excess web part away from the mail product.

12. A method for wrapping mail items of differing sizes, each mail item including at least one mail component or a stack of mail components, the method comprising:

providing a packaging assembly according to claim 1;

composing mail items on the collecting conveyor by receiving mail components from the at least one feeder and transporting the mail items on the collecting conveyor in a transport direction to the downstream end of the collecting conveyor;

wrapping a continuous web of material around the mail items by feeding a continuous web to the infeed end of the flow wrap station, placing the composed mail items subsequently on the continuous web and continuously folding the web around the mail items, thereby creating a folded web having a side fold which is positioned on a first side of the subsequently placed mail items, wherein the side fold extends in the transport direction;

cross sealing the folded web between the subsequently placed mail items and separating from the folded web an intermediate mail product comprising a downstream mail item of the subsequently placed mail items and an associated web part;

determining a transverse position of a second side of each mail item, wherein the second side is opposite the first side;

determining a transverse position of a longitudinal seal for each intermediate mail product based on the transverse position of the second side of the respective mail item; and creating a mail product by applying the longitudinal seal in each intermediate mail product at the transverse position determined for that intermediate mail product.

13. The method according to claim 12, wherein the longitudinal sealing assembly comprises:

a heat seal head, wherein the heat seal head is connected to the positioning assembly to vary and control a transverse position of the heat seal head in dependence of the transverse position of the second side of the respective mail item;

a longitudinal sealing conveyor for further transporting the intermediate mail product in the transport direction;

a transverse guide extending in a direction transverse to the transport direction;

a carriage to which the longitudinal sealing conveyor and the heat seal head are connected for varying a transverse position thereof; and a transverse actuator for moving the carriage with the longitudinal sealing conveyor and the heat seal head along the transverse guide and for positioning these at a desired transverse position;

wherein the method comprises:

creating a mail product by applying the longitudinal seal in an intermediate mail product being received on the longitudinal sealing conveyor while moving the carriage with the longitudinal sealing conveyor and the heat seal head along the transverse guide for positioning these at a transverse position corresponding to a transverse position of a longitudinal seal determined for an intermediate mail product directly upstream of the longitudinal sealing conveyor.

14. The method according to claim 12, wherein the first tilting assembly comprises a dispatch timing assembly positioned at an infeed end of the first tilting assembly, configured to control the tilting of each intermediate mail product, wherein the dispatch timing assembly comprises a plurality of support surfaces connected to a rotatable shaft and extending radially outwardly from the shaft, wherein the shaft extends substantially in the transport direction; and wherein the method comprises:

receiving a side fold of an intermediate mail product on a first of the plurality of support surfaces; and releasing the side fold, after the receiving, by rotating the rotatable shaft to move the first support surface downward.

15. The method according to claim 12, wherein determining the transverse position of the longitudinal seal for each intermediate mail product comprises:

receiving a desired transverse offset between the longitudinal seal of the intermediate mail product and the second side of the respective mail item; and determining the transverse position of the longitudinal seal for the intermediate mail product based on the transverse position of the second side of the respective mail item and the desired transverse offset.

16. A packaging assembly for wrapping mail items of differing sizes, each mail item including at least one mail component or a stack of mail components, the packaging assembly comprising:

a mail item collecting assembly including a collecting conveyor and at least one feeder for dispatching individual mail components to the collecting conveyor so as to compose the mail items which are subsequently transported in a transport direction to a downstream end of the collecting conveyor;

a flow wrap station which is configured for wrapping a continuous web of material around the mail items, wherein the flow wrap station has an infeed end which connects to the downstream end of the collecting conveyor for subsequently placing on the continuous web the mail items composed in the collecting assembly, wherein the flow wrap station comprises a folding assembly configured to continuously fold the web around the mail items, thereby creating a folded web which has a single side fold which is positioned on a first side of the subsequently placed mail items, wherein the side fold extends in the transport direction;

a longitudinal sealing assembly for creating a longitudinal seal;

a cross sealing assembly which is positioned downstream of the folding assembly and is configured for cross sealing the folded web between the subsequently placed mail items and for separating from the folded web an intermediate mail product comprising a downstream mail item of the subsequently placed mail items and an associated web part;

a measuring assembly for determining a transverse position of a second side of the mail item which is opposite the first side;

wherein the longitudinal sealing assembly has an infeed end which is positioned downstream of the cross sealing assembly, wherein the longitudinal sealing assembly is configured for creating a mail product by applying a longitudinal seal to each intermediate mail product at the second side of the mail item, wherein the longitudinal sealing assembly comprises a positioning assembly for controlling a transverse position of the longitudinal seal for each intermediate mail product, wherein the transverse position of the longitudinal seal is determined by the transverse position of the second side of the mail item, wherein the longitudinal sealing assembly comprises a heat seal head, wherein the heat seal head is connected to the positioning assembly to vary and control a transverse position of the heat seal head in dependence of the transverse position of the second side of the respective mail item, and wherein the longitudinal sealing assembly comprises:

a longitudinal sealing conveyor for further transporting the intermediate mail product in the transport direction;

a transverse guide extending in a direction transverse to the transport direction;

a carriage to which the longitudinal sealing conveyor and the heat seal head are connected for varying a transverse position thereof; and a transverse actuator for moving the carriage with the longitudinal sealing conveyor and the heat seal head along the transverse guide and for positioning these at a desired transverse position.

17. The packaging assembly according to claim 16, wherein the positioning assembly comprises:

an intermediate mail product transverse displacement assembly configured to move a respective intermediate mail product in a direction transverse to the transport direction, wherein the intermediate mail product transverse displacement assembly is positioned upstream of the heat seal head which has a fixed position.

18. The packaging assembly according to claim 17, wherein the intermediate mail product transverse displacement assembly comprises:

a guide, positioned along the transport direction at a transverse position corresponding to a transverse position of the heat seal head, and forming a narrow passage for two end flaps of the associated web part, wherein the narrow passage is small compared to a thickness of the mail item;

a clamping assembly positioned at a side of the guide opposite from the mail item and configured to clamp the two end flaps; and a push bar positioned in between the guide and the clamping assembly and configured to push the two end flaps in between the guide and the clamping assembly in an outward direction from a plane between the guide and the clamping assembly so as to pull the two end flaps through the narrow passage thereby repositioning the mail item relative to the heat seal head.

19. The packaging assembly according to claim 18, wherein the intermediate mail product transverse displacement assembly further comprises:

the measuring assembly, wherein the determining of the transverse position of the second side of the mail item comprises determining a displacement resistance of the push bar; and a displacement controller configured to reduce a displacement of the push bar, depending on the displacement resistance.

20. The packaging assembly according to claim 16, comprising:

a trimming assembly configured to remove an excess web part from the mail product, the excess web part being a part of the associated web part, wherein the excess web part is located at a side of the longitudinal seal opposite to the mail item, and wherein the trimming assembly forms part of or is located downstream of the longitudinal sealing assembly.

21. The packaging assembly according to claim 20, wherein the trimming assembly includes a suction pump having a fluid inlet, wherein the trimming assembly is configured to create a sub-atmospheric pressure between the fluid inlet and the excess web part so as to suck the excess web part away from the mail product.

22. A method for wrapping mail items of differing sizes, each mail item including at least one mail component or a stack of mail components, the method comprising:

providing a packaging assembly according to claim 16;

composing mail items on the collecting conveyor by receiving mail components from the at least one feeder and transporting the mail items on the collecting conveyor in a transport direction to the downstream end of the collecting conveyor;

wrapping a continuous web of material around the mail items by feeding a continuous web to the infeed end of the flow wrap station, placing the composed mail items subsequently on the continuous web and continuously folding the web around the mail items, thereby creating a folded web having a side fold which is positioned on a first side of the subsequently placed mail items, wherein the side fold extends in the transport direction;

cross sealing the folded web between the subsequently placed mail items and separating from the folded web an intermediate mail product comprising a downstream mail item of the subsequently placed mail items and an associated web part;

determining a transverse position of a second side of each mail item, wherein the second side is opposite the first side;

determining a transverse position of a longitudinal seal for each intermediate mail product based on the transverse position of the second side of the respective mail item; and creating a mail product by applying the longitudinal seal in each intermediate mail product at the transverse position determined for that intermediate mail product.

23. The method according to claim 22, wherein the longitudinal sealing assembly comprises:

a heat seal head, wherein the heat seal head is connected to the positioning assembly to vary and control a transverse position of the heat seal head in dependence of the transverse position of the second side of the respective mail item;

a longitudinal sealing conveyor for further transporting the intermediate mail product in the transport direction;

a transverse guide extending in a direction transverse to the transport direction;

a carriage to which the longitudinal sealing conveyor and the heat seal head are connected for varying a transverse position thereof; and a transverse actuator for moving the carriage with the longitudinal sealing conveyor and the heat seal head along the transverse guide and for positioning these at a desired transverse position;

wherein the method comprises:

creating a mail product by applying the longitudinal seal in an intermediate mail product being received on the longitudinal sealing conveyor while moving the carriage with the longitudinal sealing conveyor and the heat seal head along the transverse guide for positioning these at a transverse position corresponding to a transverse position of a longitudinal seal determined for an intermediate mail product directly upstream of the longitudinal sealing conveyor.

24. The method according to claim 22, wherein the packaging assembly comprises an alignment assembly having an infeed end positioned upstream of the longitudinal sealing assembly and downstream of the cross sealing assembly, wherein the alignment assembly is configured to move the individual mail components of the mail item to cause alignment of edges of the individual mail components of the mail item along and adjacent to the side fold, wherein the alignment assembly comprises a first tilting assembly configured to tilt the intermediate mail product around an axis of rotation from a first orientation to a second orientation, wherein the axis of rotation extends in the transport direction, wherein the second orientation is a less horizontal orientation compared to the first orientation, and wherein, in the second orientation, the gravity force exerted on the individual mail components has a force component which is directed towards the side fold, wherein the first tilting assembly comprises a dispatch timing assembly positioned at an infeed end of the first tilting assembly, configured to control the tilting of each intermediate mail product, wherein the dispatch timing assembly comprises a plurality of support surfaces connected to a rotatable shaft and extending radially outwardly from the shaft, wherein the shaft extends in the transport direction; and wherein the method comprises:

receiving a side fold of an intermediate mail product on a first of the plurality of support surfaces; and releasing the side fold, after the receiving, by rotating the rotatable shaft to move the first support surface downward.

25. The method according to claim 22, wherein determining the transverse position of the longitudinal seal for each intermediate mail product comprises:

receiving a desired transverse offset between the longitudinal seal of the intermediate mail product and the second side of the respective mail item; and determining the transverse position of the longitudinal seal for the intermediate mail product based on the transverse position of the second side of the respective mail item and the desired transverse offset.

* * * * *